US005709154A

United States Patent [19]

Schott

[11] Patent Number: 5,709,154

[45] Date of Patent: Jan. 20, 1998

[54] MONORAIL ACCESS SYSTEM FOR MAKING A BOAT HANDICAPPED ACCESIBLE

[76] Inventor: Fred R. Schott, 7619 Sandalwood Way, Sarasota, Fla. 34231

[21] Appl. No.: 754,540

[22] Filed: Nov. 21, 1996

[51] Int. Cl.[6] ..... B61C 11/04

[52] U.S. Cl. ..... 105/29.1; 105/150; 104/93; 187/201

[58] Field of Search ..... 105/29.1, 127, 105/148, 150, 463.1; 104/89, 93, 307; 187/200, 201

[56] References Cited

U.S. PATENT DOCUMENTS

| | | | |
|---|---|---|---|
| 3,985,082 | 10/1976 | Barac | 104/89 |
| 4,125,908 | 11/1978 | Vail et al. | 105/29.1 |
| 4,183,106 | 1/1980 | Grimes et al. | 4/172 |
| 4,352,218 | 10/1982 | Lundberg | 114/363 |
| 4,445,502 | 5/1984 | Swan et al. | 104/89 |
| 4,602,567 | 7/1986 | Hedstrom | 105/153 |
| 4,715,288 | 12/1987 | Catena | 105/154 |
| 4,984,955 | 1/1991 | McCullough | 414/546 |
| 5,077,844 | 1/1992 | Twitchell et al. | 5/87 |
| 5,193,650 | 3/1993 | Kent, Jr. | 187/12 |
| 5,213,045 | 5/1993 | Gersemsky | 104/93 |
| 5,219,395 | 6/1993 | Spieldiener et al. | 104/130 |
| 5,269,227 | 12/1993 | Warren et al. | 105/29.1 |
| 5,363,771 | 11/1994 | Warren et al. | 105/29.1 |
| 5,522,322 | 6/1996 | Warren et al. | 105/29.1 |
| 5,533,594 | 7/1996 | Tremblay et al. | 187/201 |
| 5,573,915 | 11/1996 | Tremblay | 187/201 |

FOREIGN PATENT DOCUMENTS

| | | | |
|---|---|---|---|
| 4272081 | 9/1992 | Japan | 187/201 |

OTHER PUBLICATIONS

Barrier Free Lifts, Inc. sales brochure on Uni Lift.

*Primary Examiner*—S. Joseph Morano

*Attorney, Agent, or Firm*—Stein, Pendorf & Van Der Wall

[57] ABSTRACT

A monorail access system for making a boat handicapped accessible. More specifically, a battery powered chair assembly is suspended from an overhead monorail track system, whereby by activating a control mechanism an individual may maneuver anywhere in the boat where the track is installed. Once an individual is seated in the chair assembly, the monorail system allows the individual to travel to the cabins, flying bridge, downstairs to the galley, outside to the rear deck for sunbathing or fishing or over the side to a dock.

15 Claims, 7 Drawing Sheets

MONORAIL ACCESS SYSTEM FOR MAKING A BOAT HANDICAPPED ACCESIBLE

BACKGROUND OF THE INVENTION

1. Field of the Invention

The present invention concerns a device and system for making a boat internally accessible to handicapped persons, and more particularly, to an overhead monorail access system whereby a disabled person can readily move forward, aftward, port and starboard onboard a boat or yacht. The monorail access system of the present invention is useful for increasing the ease in which an individual can maneuver on a boat and is easy to install.

2. Description of the Related Art

Every year thousands of boats are manufactured in the United States. In 1995 over six thousand of the boats manufactured were "inboard cruisers" and sailboats. These figures include large powerboats, yachts or luxury sailboats (boats which measure in excess of forty (40) feet in length). Even given their larger size these boats, for the most part, are internally inaccessible to disabled individuals. Specifically, narrow passageways and doorways, gunnels, steep staircases and bulkheads make maneuvering onboard a boat difficult for a disabled person and nearly impossible for an individual who is wheelchair bound. In short, as a practical matter, individuals who are severely disabled or wheelchair bound are largely excluded from the pleasures of boating.

For instance, when the owner of a large boat or a family member become infirm or disabled, the boat owner discovers that he must sell the boat. Unfortunately, this is often the case since the vessel is no longer accessible to the disabled individual, and cannot readily be made so. At the present time, there are no commercially available boats that are designed such that a handicapped individual may easily maneuver within or operate the boat. This is particularly true if the handicapped individual is wheelchair bound.

Additionally, there are few if any commercial boats, charter boats or boats for rent which are accessible to handicapped individuals. Given the breadth of the commercial fishing and charter boat industry, this may be contrary to the Americans with Disabilities Act ("ADA"), Public Law 101-336. The Americans with Disabilities Act prohibits discrimination on the basis of disability by private entities in places of public accommodation, and requires that all new places of public accommodation and commercial facilities be designed and constructed so as to be readily accessible to and usable by persons with disabilities. As evidenced by the formation of the Recreation Access Advisory Committee and the 1994 Recommendations for Accessibility Guidelines: Recreational Facilities and Outdoor Developed Areas, "recreational" endeavors such as boating and fishing do not appear to be exempt from compliance with the ADA.

Currently, if an individual wishes to make a vessel accessible for those that are disabled they must undertake expensive steps to customize the boat. Traditionally, to make a boat wheelchair and handicapped accessible one would need eliminate bulkheads, widen hallways, enlarge doorway, and add ramps, elevators and handrails. These "customizations" are very expensive and often, given the limited space available on a boat, these customizations are impracticable. Additionally, even if a boat can accommodate a wheelchair, when a boat is rolling or pitching in the waves it is very difficult to stay in the wheelchair, prevent it form rolling around or turning over.

Over the years there have been numerous devices designed which attempt to increase the access of disabled or wheelchair bound individuals. While these devices have had success in particular areas (i.e. stairway and vehicle lift systems and pool access), they are not particularly suited to provide the more extensive access required within a boat.

For instance, U.S. Pat. No. 5,193,650 (Kent, Jr.) teaches a portable stair lift system designed to assist in traversing short or medium length stairways. The device of Kent, Jr. employs a pair of spaced elongate metal plates which extend the length of the inclined staircase. To these elongate metal plates are affixed a "drive mechanism" comprising roller segments, an axle, a sprocket wheel, a sprocket chain drive, a conveyor belt and a drive wheel powered by an electric motor. A passenger seat is secured to and movable with the conveyor belt; specifically, the passenger seat or chair is provided with a depending support rod which is rotatably and slidably supported in a tube, the tube being disposed at a forty-five degree angle (following the incline of the stairway). The device of Kent, Jr. typifies a vain of handicap access devices which are designed to "lift" an individual up or down vertically along an inclined stairway. Once the disabled individual is conveyed vertically between levels, these types of devices have fulfilled their intended purpose. The device of Kent, Jr., and those that it typifies, are not designed to provide internal access within a desired local by conveying an individual within a horizontal plane.

Similarly, U.S. Pat. No. 4,984,955 to McCollough teaches a lifting apparatus installed near or upon a generally horizontal raised bed of a vehicle for safely moving a wheelchair and its occupant operator to and from the raised bed. The device of McCollough, and the vehicle lifts that it typifies, are not designed to provide access beyond lifting an individual between a first lower level and a second upper level.

There have been attempts to make a boat more usable for a disabled individual. U.S. Pat. No. 4,352,218 (Lundberg) teaches a mobile chair for use by handicapped individuals on a boat. The mobile chair of Lundberg is designed to aid an individual in handling the sails of a sailboat. The device of Lundberg is chair having a stationary mounting which permits the chair to move forwards and back, as well as permitting a rotational movement of at least a half turn in arbitrary forward/aft position.

The device of Lundberg utilizes a complex assembly comprising a chair which is axially displaceable along guide rails. Additionally, in order to permit the chair to be shifted at least 180° the seat is carried by an arcuate guide. Each end of the arcuate guide rests upon a pair sliding members which are displaceable along the guide rails. The device of Lundberg, while expanding the range of motion of a disable individual, is mounted in a stationary position and does not aid an individual in accessing different parts of a boat or ship.

There are devices available which lift and transfer individuals, particularly hospital and nursing home patients. For instance the "Uni Lift," which is distributed by Barrier Free Lifts, Inc., utilizes an overhead track system which allows a patent to be lifted and transferred to and from a bed, wheelchair, bath and toilet. Specifically, certain Uni Lift models motor up, down and along an overhead track. However, the Uni Lift device is not suited to the condition aboard a boat. In operation the Uni Lift requires a greater turning radius than available aboard a boat and an individual strapped into the Uni Lift sling cannot adjust or otherwise compensate for the movement of the boat due to waves. A disabled individual cannot readily enter and exit the sling utilized by the Uni Lift without the aid of another individual, nor does the Uni Lift device allow a disabled individual to retain their personal dignity.

Additionally, there are numerous United States patents drawn to apparatuses for the overhead transportation of heavy loads. U.S. Pat. No. 4,715,288 to Catena teaches an apparatus for the overhead transportation of loads on a monorail. The device of Catena is particularly designed for industrial applications, is mechanically complex and not suited to be mounted within the confines of a boat.

All of the above-mentioned lifts and transfer systems suffer from disadvantages which limit their usefulness and applicability to the present need. In view of the foregoing disadvantages inherent in current handicapped access devices and monorail systems, specifically the absence of a handicapped access device suitable for providing internal access onboard a boat, it is an object of the present invention to provide a monorail access system which eliminates or minimizes the above-mentioned and other problems, limitations and disadvantages typically associated with conventional "lift" devices, and provide a system which is capable of conveying an individual both horizontally and vertically along a generally linear path.

SUMMARY OF THE INVENTION

The present inventor has investigated and utilized various handicapped access devices, and discovered that external and internal access to a boat can be provided by utilizing an overhead monorail access system which will deliver a disabled individual to all areas of a boat, including cabins, the bridge and outside decks. It is an object of the present invention to provide a simple and economical monorail access system which convey a disabled individual utilizing horizontal and vertical movement.

It is a further object to provide a device and system for making a boat handicapped accessible which is readily tailorable to the particularly dimensions of the boat and the overall amount of access which is desired.

It is a further object to provide a device and system which can be operated by a disabled individual in a safe and reliable manner.

It is a further object to provide a device and system which can be self-operated by most disabled individuals.

It is a further object to provide a device and system for making a boat handicapped accessible which allows an individual to move about a vessel even when the boat is rolling and pitching in heavy seas.

It is a further object to provide a device and system for making a boat handicapped accessible which may be installed during construction of the vessel or may retrofit a current vessel, easily conforms to conventional boat dimensions, and will be readily adopted in the market as a means for making a boat handicapped accessible.

It is a further object to provide a device and system for making a boat handicapped accessible which will allow a disabled or wheelchair bound individual mobility within a boat while maintaining their dignity.

It is a further object to provide a device and system for making a boat handicapped accessible such that charter boats and other public boats may be accessible, in accordance with the Americans with Disabilities Act (A.D.A.).

It is a further object to provide a devise and system for making a boat handicapped accessible which may be disengaged and stored out of the way depending on the needs of the user.

It is a further object to provide a device and system for making a boat handicapped accessible.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the concept and the specific embodiments disclosed may be readily utilized as a basis for modifying or designing other aerators for carrying out the same purposes of the present invention. It should also be realized by those skilled in the art that such equivalent structures do not depart from the spirit and scope of the invention as set forth in the appended claims.

DETAILED DESCRIPTION OF THE DRAWINGS

For a fuller understanding of the nature and objects of the present invention reference should be made by the following detailed description taken in with the accompanying drawings in which:

FIG. 1 is a cross-sectional view of the monorail access system of the present invention, illustrating the chair assembly rotated 90° from its forward orientation and a preferred motor orientation;

FIG. 1*a* is a cross-sectional view of the monorail access system of the present invention, illustrating an alternative motor orientation;

DETAILED DESCRIPTION OF THE INVENTION

Figure 1:
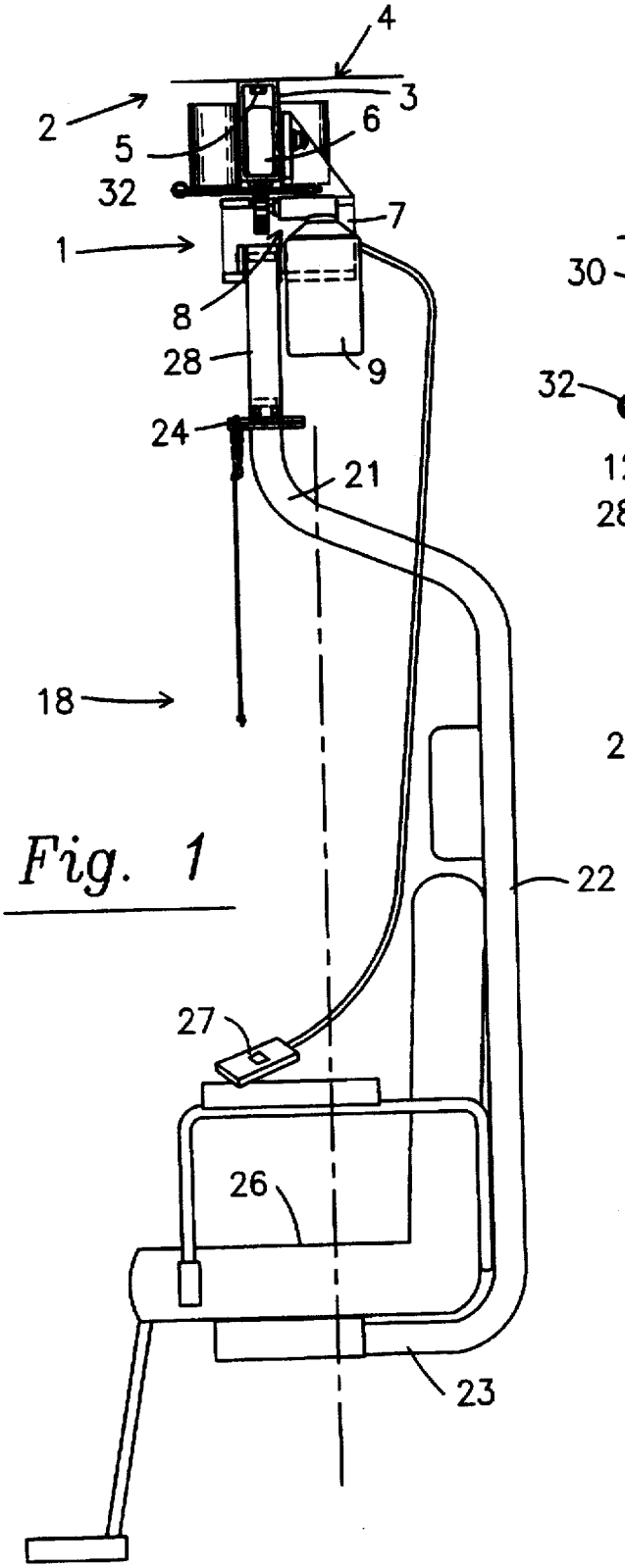

As a paraplegic who has been wheelchair bound for thirty years the present inventor is acutely aware of the access difficulties a disabled individual faces. While access to buildings and transportation is a challenge to a disabled individual, these difficulties are compounded when attempting to access and move throughout a boat. After extensive investigation, the present inventor has discovered a device and system whereby boats under construction or already manufactured boats can be made handicapped accessible to wheelchair bound or individuals with limited mobility.

More particularly, a battery powered chair assembly is suspended from an overhead monorail track system, whereby by activating a control mechanism an individual may maneuver anywhere in the boat where the track is installed. Once an individual is seated in the chair assembly, the monorail system allows the individual to travel to the cabins, flying bridge, downstairs to the galley, outside to the rear deck for sunbathing or fishing or over the side to a dock.

The dimension of the device and system of the present invention will vary depending on the type and size of the boat upon which the monorail access system is to be installed. These dimensional variations may include, but are not limited to, the length of the tract system, the size and orientation of the driving motor and the overall length of the chair assembly.

A "monorail" can be defined as a transport system utilizing a single rail or track. The monorail access system of the present invention may utilize any commercially available box track or C-shaped channel track (hereinafter C-channel) for the overhead suspended track upon which a chair assembly carrying the disabled individual travels. Alternatively, I-beam may be utilized with for the overhead track. However, the use of I-beam for the overhead track would require a varied orientation of the support wheels. Preferably, the overhead track is an extruded C-channel track, preferably extruded aluminum so that the overhead track is strong, lightweight and resistant to marine salinity and inclement weather. The overhead monorail track is preferably constructed of aluminum, however, stainless steel or some other appropriate material can be used in construction.

The overhead track should be capable of conveying weights between 300 and 700 pounds. The C-channel may be oriented with the groove defined therein oriented in either a right-hand or left-hand position. For simplification the C-channel is consistently shown in a right-hand orientation in the figures. Preferably, the overhead track is somewhat compact so that the monorail access system can be discretely mounted on the ceiling of a luxury sailboat without greatly reducing overhead clearance. More preferably, the C-channel is between 3 and 6 inches high and 1½ and 2½ inches wide. The internal dimensions of the C-channel, which configure a groove defined therethrough, are preferably 4⅕"×1¾". The opening of the groove, which extends the length of the C-channel, is preferably between 1 and 2 inches high.

The overhead track has a top portion which is coupled to the ceiling of a boat or overhead support and a bottom portion to which a engagement surface is attached. The overhead track may be coupled to the ceiling of the boat or ship utilizing any mechanism known in the framing or boating industries, including but not limited to rivet or screws. Preferably, the overhead monorail track is coupled at multiple locations, spaced at intervals far enough apart, such that the track may wind throughout the boat yet remain securely attached to the ceiling. If necessary, based upon the particular structure of the boat, the overhead track and boat ceiling may be reinforced in any suitable manner (not shown).

As an additional feature, a length of overhead track coupled to a hinge mechanism may be provided whereby the track may swing out over the side of the boat supported by a boom or to a support located on the dock, thereby permitting the monorail access system of the present invention to be utilized to enter and disembark the boat.

In a further refinement the suspending hardware and tract materials are weather-resistant to allow track and suspending hardware to remain out-of-doors, exposed to salt air, without corroding or otherwise degrading.

Housed within the groove defined through the C-channel, and capable of uniaxial movement (i.e. slide or rolling) therein, are a pair of weight bearing wheels. The weight bearing wheels are preferably ball bearing type wheels, manufactured having a high impact molded rubber composition core with a hard rubber stain-resistant, nonmarking thread molded thereto. The wheels should be rated for light to medium-heavy commercial, industrial and institutional applications. The hard rubber wheels should roll easily, resist oil and water and handle high load capacities. The weight bearing wheels should utilize bolt and locknut wheel axles, preferably the axles is between 1½ and 3⅜ inches in length and having a diameter between ¼ and ½ of an inch. Alternatively the wheels may be constructed of combinations of polyurethane, phenolic, urethane or rubber. For instance hard rubber wheels, part number HRB-3H2 of the HR Series, manufactured by Triopines of Atlanta, Ga. are suitable.

Preferably, the height of the weight bearing wheels is between 2 and 5 inches, more preferably 3 inches and the thread width of the weight bearing wheel should be between 1⁷⁄₁₆ and 2 inches. The weight bearing wheels can be mounted to the drive assembly utilizing any traditional hardware in the caster or wheel industry.

In an alternative embodiment, the weight bearing wheel can be a "v-grooved" wheel designed to travel on an angular or round rod guidance rod.

The present invention further comprises a drive assembly housing. The dimensions of the drive assembly housing may vary depending on the orientation of the motor and the height of the C-channel. Preferably, the external dimensions of the drive assembly housing are 12 inches wide by 16 inches long and 12 inches deep. Because of the unique nature of the drive assembly housing it must be custom manufactured, preferably from aluminum or steel. The weight bearing wheels are coupled to angle brackets disposed at the upper region of the drive assembly housing while the lower portion on the drive assembly housing defines a recess which encloses the batteries, motor and gear assembly of the present invention. Further, counter balance rollers are mounted on the top surface of the drive assembly housing.

A chair assembly is coupled to the drive assembly housing, specifically, a chair assembly connector is releasably engaged in a slot defined in the drive assembly housing. The entire chair assembly is carried by the wheels displaced within the overhead track. The chair assembly comprises a chair having a seat with a back-rest and a foot-rest. The arrangement is made to suit disabled individuals and the particular shape of the chair may vary within wide limits to meet different demands (i.e., the chair may be provided with removable or pivotable armrests to facilitate an individual in entering and exiting the chair itself). Preferably, the chair itself is manufactured of a conforming one-piece, high impact polypropylene. However, aluminum, high-density polyethylene, polypropylene, ABS Resins (composed of acrylonitril, butadiene, and styrene) or any lightweight, strong and non-corroding material. Optionally, the chair may be padded for provided with upholstery for added comfort.

Since an important aspect of the present invention is the ability of the monorail access system to transport disabled individual throughout a boat, including to the head and cabins, the chair assembly is preferably somewhat compact and narrow.

In an alternative embodiment, the chair assembly may have an actuator system incorporated therein. For instance, Model No. 19675 Regular Model Mobile Lift, manufactured by Burr Engineering Company, is suitable. The Burr actuator permits the chair assembly to be raised-lowered a full eighteen (18) inches to ensure the chair assembly clears a step over bulkhead.

Preferably, the foot rest features a wide non-skip surface for safety. Additionally, the chair may be provided with a safety belt of other restraint means.

The monorail access system of the present invention may be powered by any commercially available low voltage motor (⅓ to ¾ horsepower). Ideally the motor should feature high starting torques for heavier load applications, linear speed/torque characteristics over the entire speed range and be capable of being powered by 12 volt deep cycle batteries run in parallel. For instance, the line of NEMA (National Electrical Manufacturers Association) Frame Low Voltage Motors manufactured by Leeson Electric Motors, particularly the ½ horse/24 volt model, are suitable.

As a further refinement, the drive assembly of the present invention may utilize a low voltage adjustable speed control to produce a 30:1 stepless speed range when used with permanent magnet 24 volt DC motors. The advantage of utilizing an adjustable speed control is that a greater running time between charges is possible than with more traditional methods (such as using resistance in series with the batteries).

In another refinement, the drive assembly of the present invention may utilize a clutch mechanism to ensure complete user control of the drive assembly. Specifically, a type DC roller clutch, or any commercially available clutch/brake or C-Face clutch, may be utilized depending on the horsepower and speed of the motor and the NEMA enclosure type and frame. Basically, starting and stopping of the load is achieved by switching between the clutch and brake. The load will start when voltage is applied to the clutch and will stop when voltage is applied to the brake. As a further refinement, to facilitate sliding the chair assembly when the motor is non-operational, a neutral switch may be provided.

Additionally, the monorail access system of the present invention may be controlled by any commercially available control system. Preferably, the control system is equipped with a double pull double throw monetary switch having on/off/on settings. Additionally, the monorail access system of the present invention may utilize air tube hand controls in order to minimize any safety concerns associated with operation of the system in wet conditions (i.e. while on deck).

Further examples of chairs, safety features, monorail switching mechanisms and control mechanisms are disclosed by the following U.S. Patents, the disclosures of which are incorporated herein by reference:

5,373,915 PASSENGER LIFT WITH AN ELECTRIC SAFETY LOCK 5,219,395 MONORAIL TRANSPORT SYSTEM 5,077,844 MECHANICAL APPARATUS FOR LIFTING AND MOVING HUMANS 4,183,106 SWIMMING POOL LIFT FOR THE HANDICAPPED

The most significant features of the present invention is the combination of an elongate overhead monorail track, a chair assembly dimensioned to "clear" bulkheads and narrow passageways and a drive assembly which utilizes a roller clutch and counterbalance rollers which prevent the chair assembly from pitching from side to side when the boat rocks. In particular, the device of the present invention is not only capable of conveying a disabled individual vertically along a track(i.e. from the deck to the bridge) but also horizontally along the path of the overhead monorail track.

The device and assembly according to the present invention will bow be discussed in greater detail by reference to the drawings.

Figure 2:
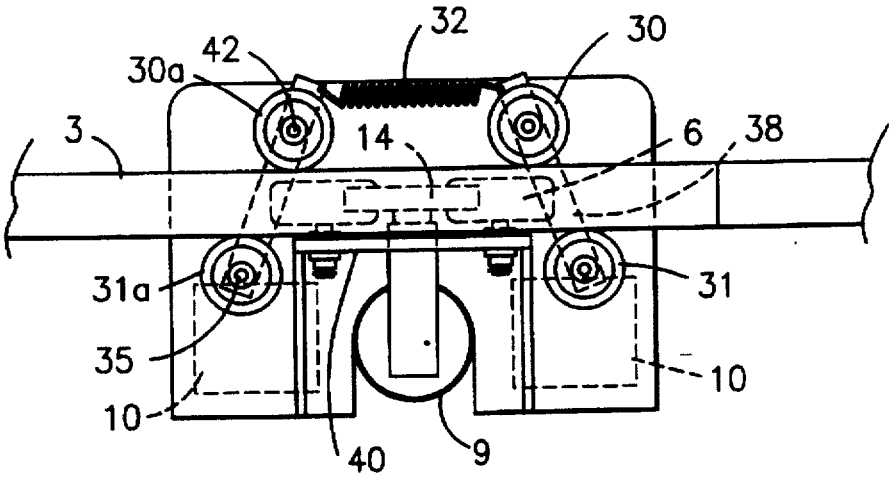
FIG. 2 is a top view of the drive assembly of the monorail access system of the present invention, illustrating the orientation of the weight bearing wheels within the C-channel.

FIG. 1 illustrates a cross-sectional view of the monorail access system of the present invention 1. The monorail access system of this invention includes an overhead track 2, this overhead track is preferably an elongate length of C-channel 3 coupled to the ceiling of the boat 4. Preferably, the C-channel is installed in segments such that, if necessary, a short segment of the overhead track can span a hallway or space where the boat ceiling may not be of uniform height. Housed within the groove 5 defined through the C-channel, and capable of uniaxial movement (i.e. slide or rolling) therein, are a pair of weight bearing wheels 6. The weight bearing wheels 6, are coupled to a drive assembly housing 7. The drive assembly housing 7, which is generally rectangular in configuration, has an opening defined therein in which encompasses the motor batteries 10 (FIG. 2). Additionally, the monorail access system has a drive assembly 8 which propels the chair assembly along the overhead track.

In an alternative embodiment, two or more guide wheels may be disposed within the overhead track.

Figure 1A:
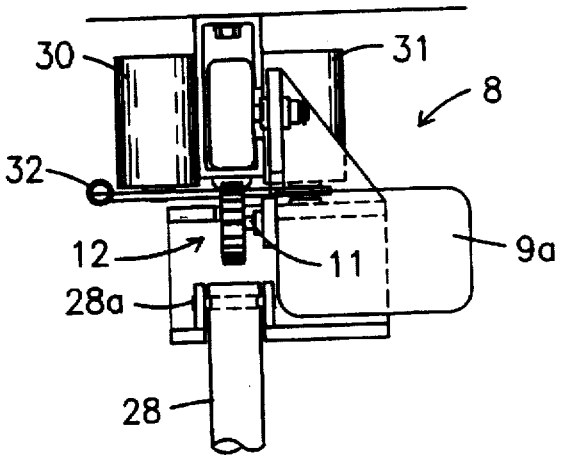

As illustrated in FIG. 1 and 1A, the drive assembly 8 comprises a motor 9 and 9*a*, a drive shaft 11 which extends through the motor casing (not shown) and a gear mechanism 12. Basically, a gear mechanism is a machined element that transmits motion and power by means of successively engaging teeth. In the present application, a spur gear is appropriate to provide parallel and linear motion in one plane. As illustrated in greater detail in FIG. 2, in the present application, the gear mechanism is preferably a toothed sprocket or spur gear 14 which engages an engagement surface 16. If a sprocket is to be utilized, an HTS 8 mm sprocket, such as manufactured by Martin may be used.

In a further refinement, the drive assembly may additionally be provided with a motor speed reducer (not shown). The particular type of reducer will vary depending on the motor NEMA configuration and gear mechanism. As an example, Model E134 Worm Gear Flanged Reducer, size 715, manufactured by Boston Gear may be suitable.

The engagement surface 16 may either be a rubberized longlenth HTD© belt (such as manufactured by Gates) or a elongate steel rack. Preferably, the face width of the engagement surface, whether a rubberized belt or steel rack, is between ½ and 1¼ inches. More preferably the face width of the engagement surface is ¾ of an inch. The engagement surface may be coupled to the overhead tract utilizing any means customary in the trade, including but not limited to adhesives or riveting. However, as will be discussed in greater detail below, when there is a bend in the overhead track, the face width of the engagement surface must decrease accordingly.

The motor may be mounted to the drive assembly housing via stud bolts extending from either the front or rear of the motor. FIG. 1 illustrates a first motor mounting orientation, specifically, the motor 9 is mounted at a right angle to the drive shaft. Motors having this "right angle" shaft orientation include predominantly worm type models, right angle gear motors tend to be of heavier construction, handle higher shock loads and run quieter than comparably sized parallel shaft design engines. FIG. 1A illustrates a second motor mounting orientation, specifically, the motor 9*a* is mounted parallel to the drive shaft. Parallel shaft models include helical and spur gear designs. Parallel shaft gear motors offer high efficiency in compact packages.

The motor may be powered by any suitable means such as an internal battery, an external portable battery, or via electrical connections to the main electrical supply system of a boat (in which case the electric drive motor includes insulated and encased electrical conductors). However, the motor is preferably powered by two 12 volt batteries 10 run in parallel in order to increase battery life (FIG. 2).

Further, FIG. 1 illustrates the chair assembly 18 in which the disabled individual is seated while the monorail access system is in operation. The chair assembly comprises a support unit 20, having a top portion 21, a center column 22 and a bottom platform 23. At the top portion of the support unit is joined a axially rotating joint 24 with means for locking against rotation 25. At the bottom platform 23 of the support unit is coupled a chair 26 or other seating surface. The means for locking against rotation 25 permits the disabled individual seated in the chair assembly to rotate the orientation of the chair assembly (see FIG. 7).

The support unit may be constructed of hollow aluminum tubing, hollow steel rod, solid steel rod or some other appropriate material could be used as well. Hollow aluminum tubing is preferable for construction of this structural member because it is strong and lightweight.

To ensure that the monorail access system of the present invention accomplishes its intended purpose, namely conveying a disabled to all areas of a boat, the chair assembly is preferably constructed such that the support unit is between 3 to 4 feet high from the top portion to the base portion. Additionally, the chair and chair assembly is preferably between 12 and 24 inches wide, more preferably the chair and chair assembly is preferably between 16 and 20 inches wide, most preferably the chair assembly is 18 inches wide.

The chair 26 may be coupled to the support unit by any mounting conventional in the art (not shown). Additionally, the chair may be provided with a seat belt (not shown). For instance, tongue receptacles manufactured of aluminum may be attached to the support unit and corresponding support tongues may be coupled to the chair. The use of tongue and receptacle hardware permits the chair to be removed from the support unit for easy storage. Alternatively, the chair may simply be rivoted or screwed to the support unit platform.

Figure 8:
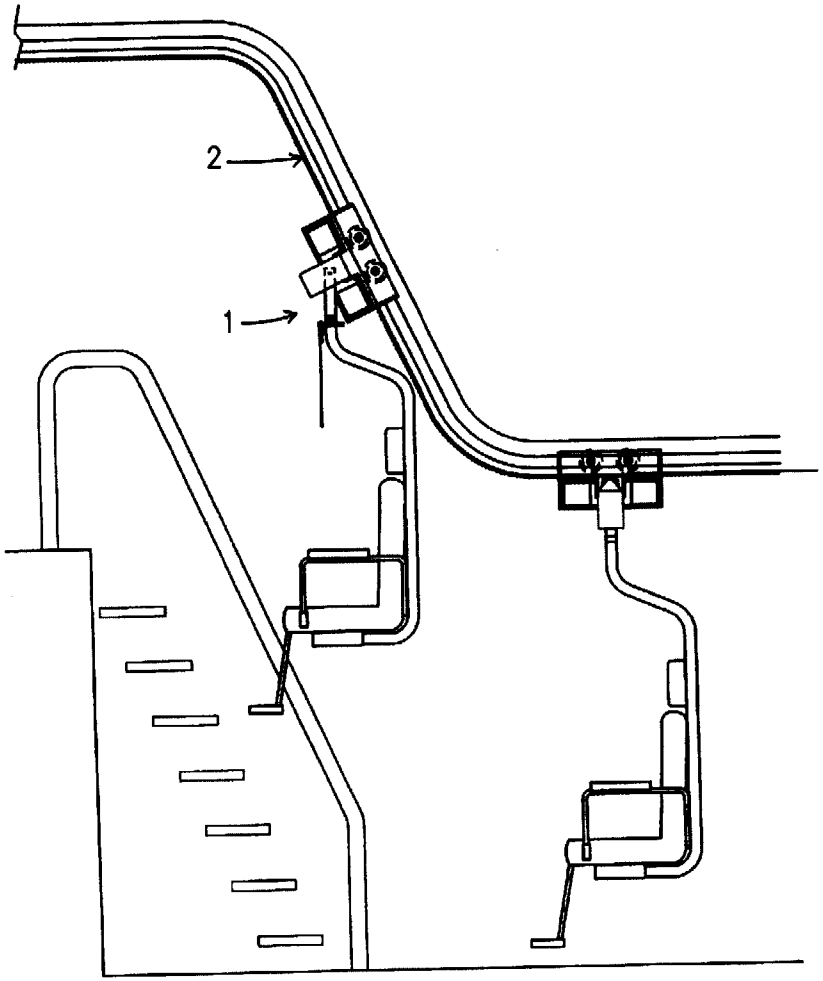
FIG. 8 is a side view of the monorail access system of the present invention, illustrating the vertical movement of the chair assembly.

The chair assembly is coupled to the drive assembly housing, by means of a chair assembly connector 28. More specifically, the a chair assembly connector is releasably and pivotally engaged in a slot defined in the drive assembly housing 28*a*. This mounting is significant for two reasons. First, since the chair assembly is pivotally connected to the drive assembly housing the chair assembly remains consistently oriented, even when the monorail access system is pulling up a steep grade (FIG. 8). Secondly, the chair assembly can be readily removed from the drive assembly housing for storage.

In order to actuate the monorail access system of the present invention, a control mechanism 27 is provided whereby the individual seated in the chair assembly may readily control the movement of the drive assembly and chair assembly.

FIG. 2 illustrates the orientation of the components of the drive assembly in greater detail. FIG. 2 is a top view of the drive assembly of the monorail access system of the present invention, illustrating the orientation of the weight bearing wheels 6 within the C-channel 3. In order to ensure the smooth operation of the monorail access system of the present invention, and to maintain the drive assembly in-line, the system is provided with a plurality of counter-balance rollers guide wheels (hereinafter rollers). More particularly a pair of rollers and 30*a*) engage the C-channel opposite the motor and serve to counter-balance the drive assembly housing and prevent the chair assembly from rocking side-to-side on inclement seas. Positioned opposite from rollers 30 and 30*a* are an additional pair of rollers (31 and 31*a*) aid in providing tension. Biasing the rollers against the C-channel is a spring bias coil 32.

The spring bias may be of any construction capable of storing tension or torsional energy as return energy, but preferably comprises a metal spring member in the shape of a helical coil, coiled about an axis. The spring bias may be made of any suitable material, and is preferably made of metal, but may be any other spring means such as an elastic cord such as a bungee type elastic cord. More preferably, the spring bias 32 is an extension spring, approximately 7 inches long by 1.5 inches wide, manufactured of stainless steel with a 243 wire diameter and a 112 pound capacity.

When the drive assembly encounters a bend in the track, the spring bias coil 32 ensures that the rollers maintain constant contact and pressure with the C-channel, thereby preventing the monorail access system from becoming "derailed". The counter balance rollers, may constructed of nylon, plastic, or other appropriate material. Preferably, the rollers are constructed with sealed bearings. The four inch high by two in wide roller, having a ⅝ bore bearing axle, manufactured by Florida Industry Sales of Orlando, Fla. is suitable for this purpose. A first pair of rollers 31 and 31*a* are held in position and turn on pins or stems 35 which are coupled to the top surface of the drive assembly housing 37. Attached to the roller stems 35 are elongate mounting hardware 38 to which a second pair of rollers 30 and 30*a* are mounted by similar pins 42. The elongate mounting hardware is capable of being positioned by the spring bias 32.

FIG. 2 further illustrates how the weight bearing wheels 6 are mounted through an angle bracket 40 formed in the drive assembly housing.

Figure 3:
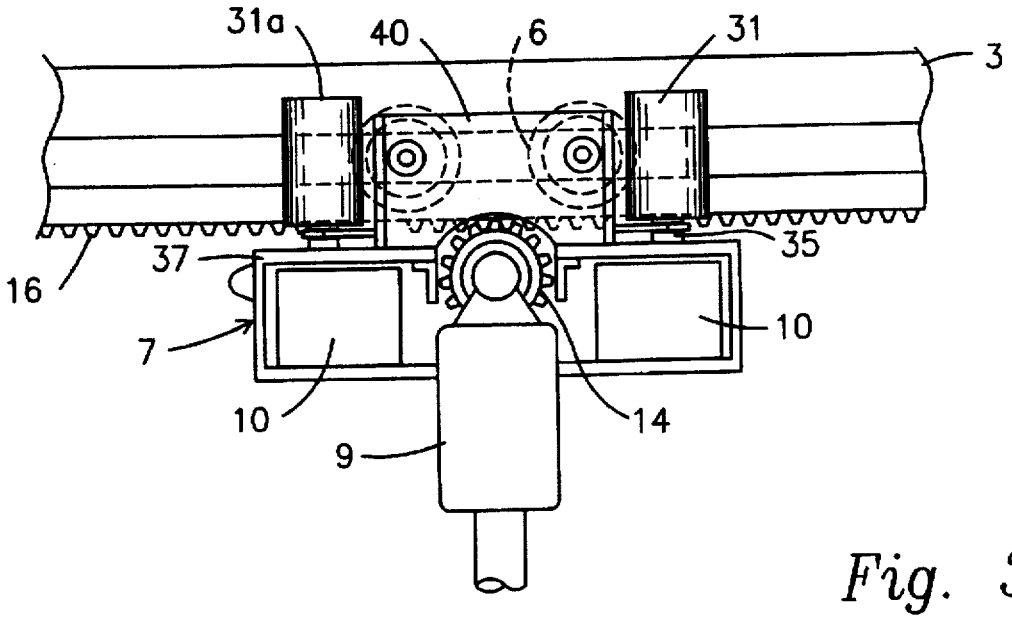
FIG. 3 is a side view of the drive assembly of the monorail access system of the present invention, illustrating the orientation of the counter balance rollers, engagement surface and gearing.
Figure 4:
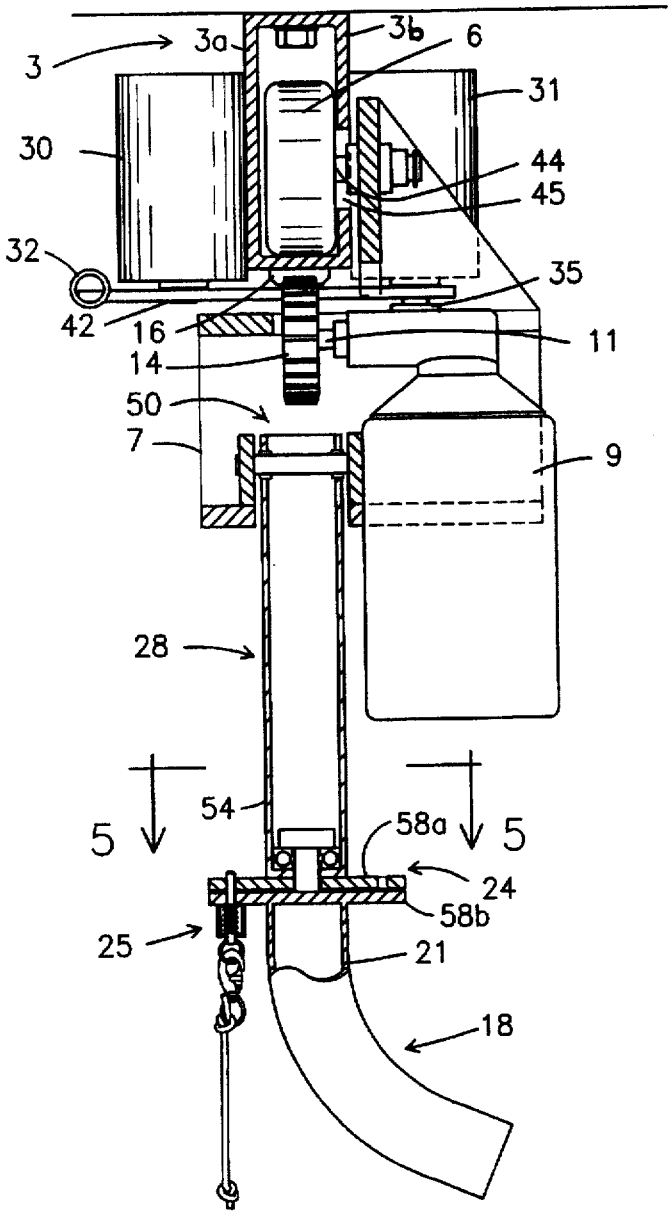
FIG. 4 is a cross sectional view of the drive assembly of the monorail access system of the present invention, illustrating in detail the mounting hardware, an axially rotating joint, motor orientation and pivotal mount of the chair assembly.

FIG. 3 is a side view of the drive assembly, drive assembly housing and overhead tract of the present invention. Specifically, the drive assembly housing 7 has a space defined therein which encloses two 12V batteries 10. As illustrated by FIG. 3, the drive assembly serves as the driving mechanism for the monorail access system. Upon activating the control mechanism 27, the electric motor 9 is energized and the drive shaft (not shown) rotates causing corresponding rotation of the spur gear 14. The spur gear 14 meshes with the steel or rubberized rack 16, thereby transmitting the energy and motion of the motor to propel the drive assembly housing 7, weight bearing wheels 6 and attached chair assembly (not shown) in the desired direction along the C-channel 3. To ensure efficiency and smooth operation, the spur gear 14 and corresponding rack 16 should have the same number of teeth, same pitch and pressure angle. FIG. 4 illustrates in greater detail the C-channel, drive assembly and chair assembly connector. As shown in FIG. 4, to ensure smooth operation, the weight bearing wheels 6 should be in rather close tolerance with the sides 3*a* and 3*b* of the C-channel 3 as they revolve in the groove 5 defined therein. The wheel stems 44 extend through opening of the groove 45, the weight bearing wheels 6 can be mounted to the drive assembly utilizing any traditional hardware in the caster or wheel industry.

The orientation of gear rack 16 and gear 14 can be readily varied, however, in order to reduce wear and tear on a rubberized gear rack and to increase battery life, the gear rack is preferably mounted on the external surface of the C-channel (FIG. 3).

FIG. 4 illustrates the chair assembly connector 28 in greater detail. The chair assembly connector has a first end 50 which is releasably and pivotally connected to the drive assembly housing 7. The chair assembly connector is displaced within a slot 28*a* in the drive assembly housing (not shown). By utilizing a removable pivot/slot coupling for the monorail access system of the present invention, the chair assembly may readily be removed from the drive assembly to facilitate storage. The pivot 52 may be either manufactured integrally with the chair assembly connector or coupled thereto by any suitable means. Further, the chair assembly connector has a second end 54 which is coupled to the top portion 21 of the chair assembly 18. Preferably, the chair assembly connector 28 and the chair assembly 18 are joined by means of a axially rotating joint 24. More preferably, the axially rotating joint has a means for locking against rotation 25 which permits the individual utilizing the monorail access system of the present invention to vary the orientation of the chair assembly. The ability to vary the orientation of the chair assembly is particularly useful onboard a boat. For instance, given the close quarters within the cabins and galley, the disabled individual may wish to utilize the monorail access system and chair assembly as a place to sit in addition to a means for transport within the boat. In the galley (or kitchen) the overhead track may be installed close to a table, then in order to sit at the table the individual seated in the chair assembly simply orients the chair perpendicularly form the overhead track (FIG. 1).

In an alternative embodiment, the chair assembly connector 28 is an extention of the top portion of the chair assembly, manufactured without an axially rotating coupling joint. In this alternative embodiment, the chair assembly may have an actuator system incorporated therein (not shown). The actuator permits the chair assembly to be raised and lowered a full eighteen (18) inches to ensure the chair assembly clears a step over bulkhead.

Figure 5:
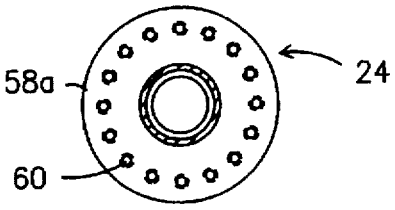
FIG. 5 is a sectional plan view of a axial rotating joint of the type which may be utilized in the monorail access system of the present invention, taken along section 5—5 at FIG. 4.

FIG. 5 illustrates a sectional plan view of a axial rotating joint of the type which may be utilized in the monorail access system of the present invention, taken along section 5—5 of FIG. 4. The axially rotating joint 24 of the present invention will be custom manufactured; however, any axially rotating joint commercially available may be utilized. The axially rotating joint may be manufactured of extruded aluminum or a custom die. As shown in FIG. 4, the axially rotating joint is comprised of a pair of plates 58*a* and 58*b* having holes defined therethrough, which when aligned, receive the means for locking against rotation.

As illustrated in FIG. 5 the plates 58*a* have a series of holes 60 defined therethrough at regular intervals sized to receive the means for locking against rotation.

Figure 6:
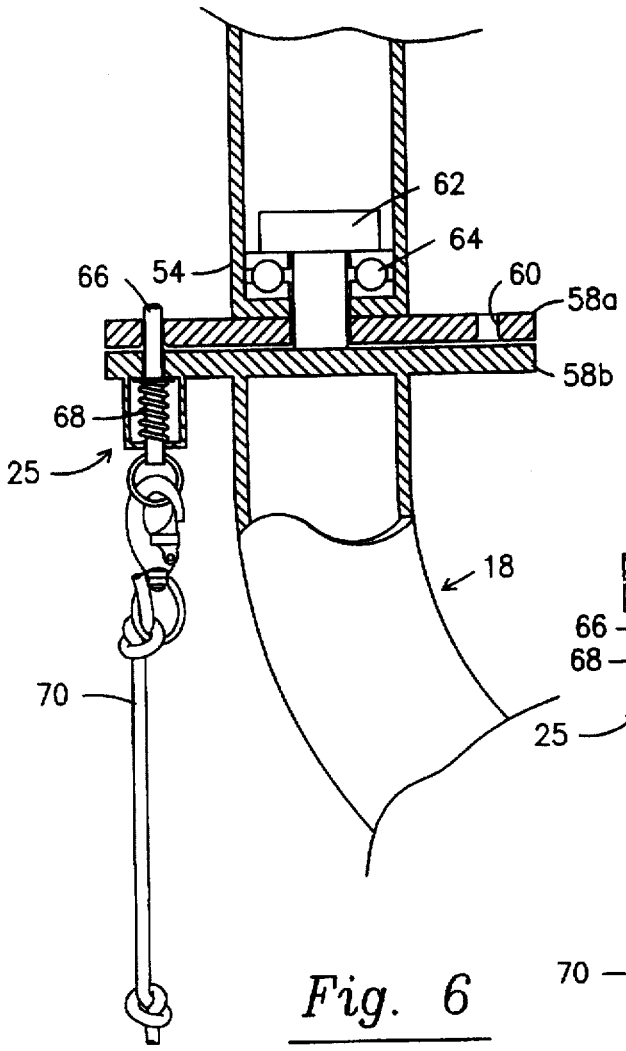
FIG. 6 is a detailed cross sectional view of the axial rotating joint illustrating the means for locking against rotation.
Figure 7:
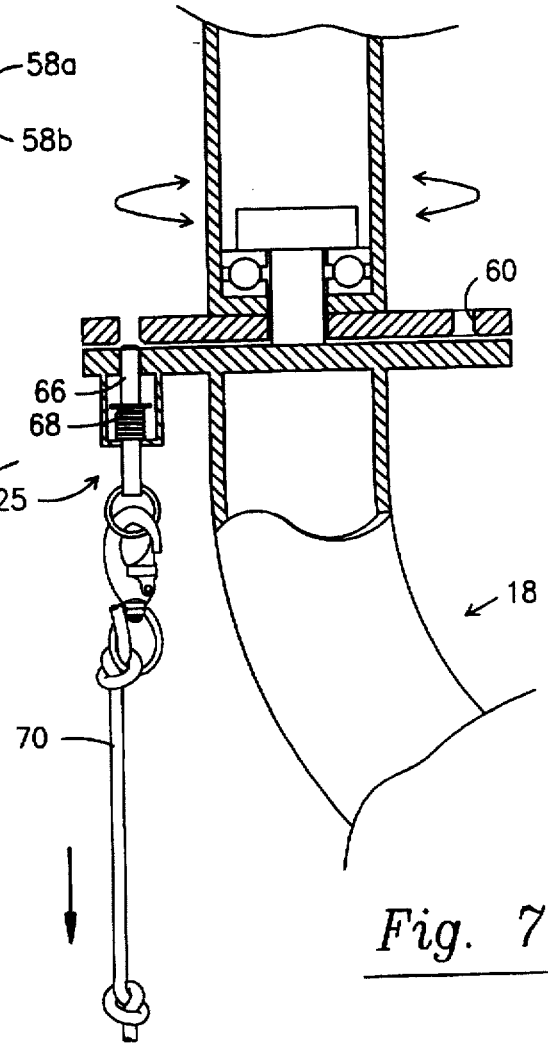
FIG. 7 is a detailed cross sectional view of the axial rotating joint illustrating the stop pin removed to allow rotational movement as shown.

FIGS. 6 and 7 illustrate the axially rotating joint 24 with means for locking against rotation 25 in greater detail. Disposed within the second end 54 of the chair assembly is a t-joint 62 with bearings 64 which permits the axially rotating joint to rotate. The means for locking against rotation 25 comprises a stop pin 66, a retracting spring 68 and a pull 70. As shown in FIG. 7, in order to rotate the orientation of the chair assembly 18 the user simply exerts a downward force upon the pull 70 thereby causing the retracting spring 68 to withdraw the stop pin 66 from the holes defined through plates 58*a* and 58*b*. When the chair assembly has reached the desired orientation, and the plate holes 60 are aligned, the user simply removes the downward force from the pull 70 thereby permitting the retracting spring 68 to urge the stop pin back in place.

FIG. 8 is a side view of the monorail access system of the present invention, illustrating the vertical movement of the chair assembly as it travels past a ship's ladder. Preferably, the monorail access system of the present invention, utilizing a low voltage motor with a high starting torque, with a gear/engagement surface is capable of conveying in excess of 400 pounds up a steep grade.

Figure 9:
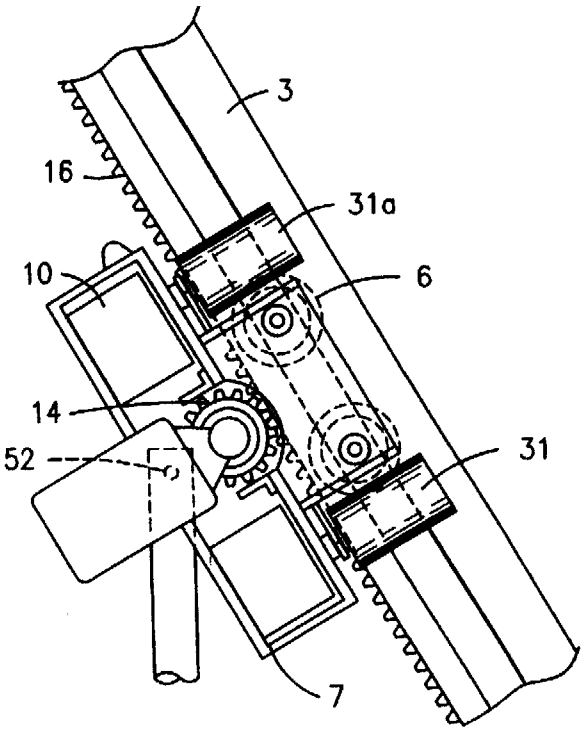
FIG. 9 is a detailed cross-sectional view illustrating the gear and belt assembly.

FIG. 9 is a detailed cross-sectional view illustrating the gear 14 and rack 16 of the present invention as the drive assembly 8 draws the chair assembly up an incline. The pivot and slot coupling of the chair connector assembly 28 to the drive assembly housing 7 permits the pivot 52 to rotate as the monorail access system travels up or down an incline, thereby maintaining the chair assembly in a stable position. Further, the rollers 30,30*a*, (not shown) 31 and 31*a* prevent the chair assembly from swinging from side-to-side.

Figure 10:
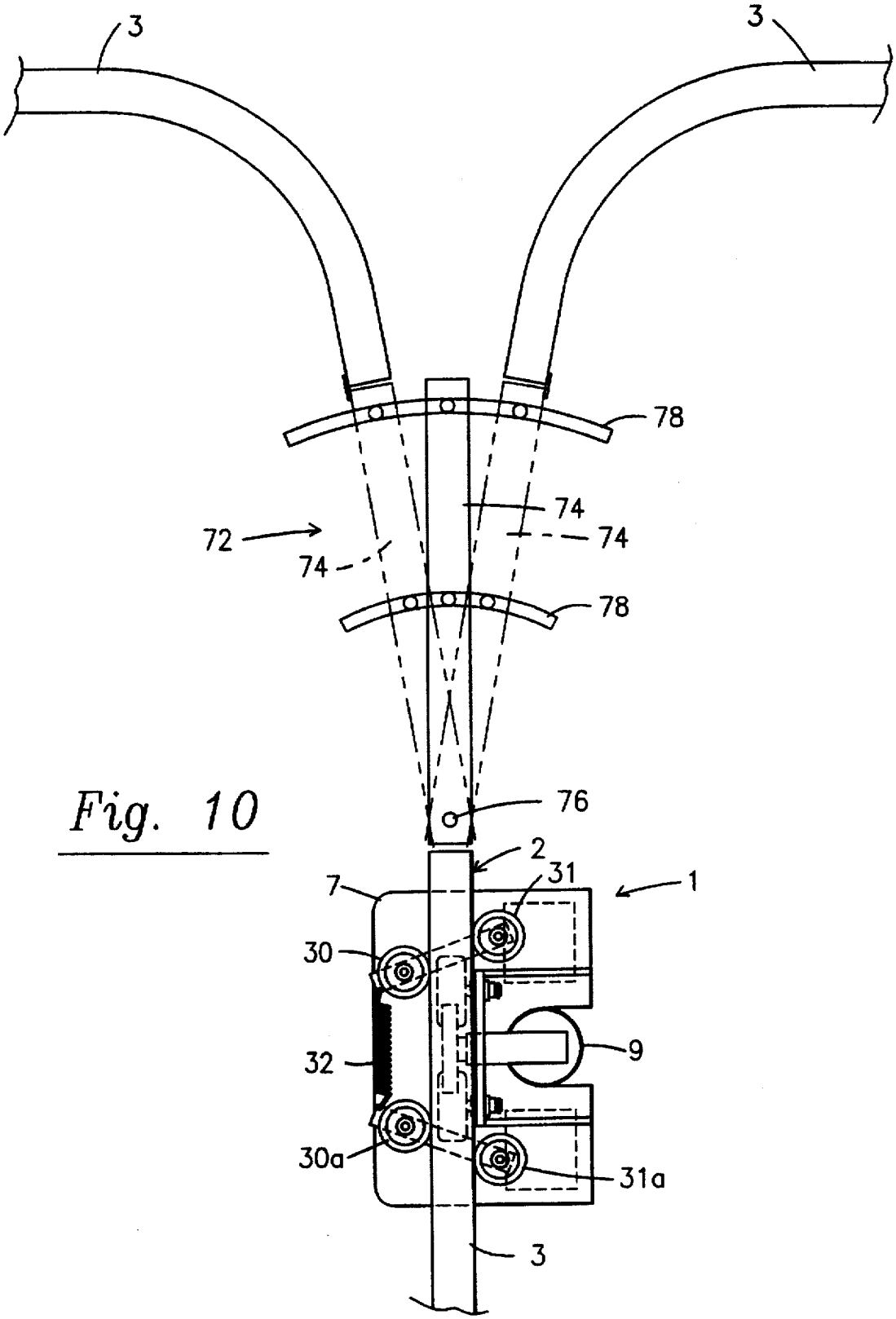
FIG. 10 is a top view of the drive assembly and pivotally mounted monorail track.

FIG. 10 depicts a top view of the monorail access system of the present invention 1 as it encounters an turn in the overhead track 2. As the drive assembly 7 and chair assembly (not shown) approach a right or left turn in the overhead track a switching mechanism 72 diverts the chair assembly onto the desired path. The switching mechanism 72 may either be a manual pivot or a magnetic electrical switching system. Any switching mechanism known in the art may be utilized in the overhead track. Essential to the operation of the switching mechanism 72 is a articulated segment of track 74 fixed to the overhead track 2 by a pivot pin 76 and arcuate shaped support bearings 78. The articulated segment 74 and support bearings 78 are supported by a support strut attached to the ceiling (not shown). As the drive and chair assembly enter and travel through the curve, the spring bias and rollers help retain the weight bearing wheels 6 in-line within the overhead track. Furthermore, in order to ensure the engagement of the spur gear and toothed engagement surface, the face width of the engagement surface is decreased to approximately ½ inch through the curve.

Figure 11:
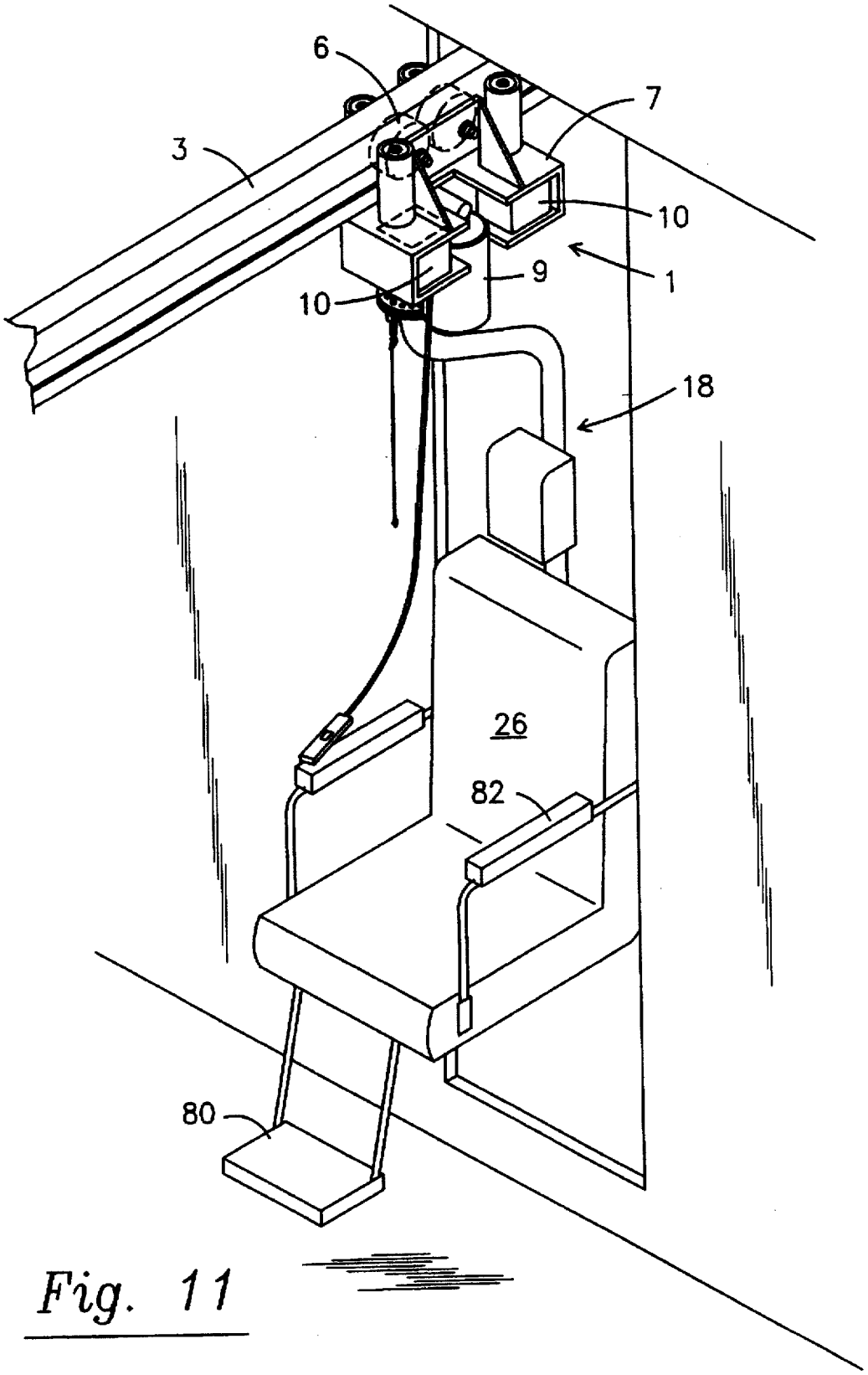
FIG. 11 is a perspective view of the monorail access system of the present invention, illustrating the chair assembly just prior to passing through a boat doorway and clearing the bulkhead.

FIG. 11 illustrates the monorail access system of the present invention i as it emerges from a doorway having a step-over bulkhead. In FIG. 11 the position of the batteries 10, motor 10 and the drive assembly housing 7 can be seen in greater detail. Additionally, FIG. 11 provides a clear view of the chair assembly 18 and chair 26, including footrest 80 and arm rests 82.

The monorail access assembly system of the present invention must be durable enough to support not only its own weight but the additional weight of a disabled individual seated in the chair assembly.

Although the device and system of the present invention was first designed to provide access within a boat, it will be readily apparent that the device is capable of use in a number of other applications, such as for use within a home, public building or camper. Although this invention has been described in its preferred form with a certain degree of particularity with respect to handicapped access for a boat and marine environment, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. A monorail access system for conveying an individual, comprising:

an elongate overhead track, having a bottom portion and a top portion, said top portion being joined to an overhead support, wherein said overhead track has a channel defined therethrough;

an engagement surface provided at the bottom portion of said elongate overhead track, a drive assembly housing;

a drive assembly, said drive assembly comprising a motor, a drive shaft extending from and driven by said motor and a gear mechanism which is secured to and rotatable with said drive shaft, wherein said gear mechanism engages said engagement surface, thereby propelling the drive assembly forward or in reverse;

a power source located within said drive assembly housing, wherein said power source powers said drive assembly;

a pair of weight bearing wheels disposed within said channel, wherein said wheels are uniaxially movable, said wheels being connected to said top surface of said drive assembly housing;

a chair assembly pivotally coupled to and suspended from said drive assembly housing; and a control means, for controlling movement of the drive assembly.

2. A monorail access system for conveying an individual as in claim 1, further comprising:

a first and second pair of rollers mounted on opposing sides of said overhead track; wherein said first pair of rollers are coupled to the drive assembly housing by means of a pair of pins, said second pair of rollers are joined to said first pair of rollers by means of movable elongate mounting hardware, said second pair of rollers coupled to said elongate mounting hardware by a pair of pins; wherein said elongate mounting hardware is capable of being biased by means of a spring.

3. A monorail access system for conveying an individual as in claim 1, wherein said chair assembly comprises:

a support unit having a top portion, a center column and a bottom platform; and a chair coupled to said support unit at the bottom platform.

4. A monorail access system for conveying an individual as in claim 3, wherein said chair further comprises a footrest and arm rests.

5. A monorail access system for conveying an individual as in claim 3, wherein said chair assembly further comprises:

a axially rotating joint and means for locking against rotation formed in said chair assembly, whereby an individual seated in said chair assembly may change the orientation of the chair assembly.

6. A monorail access system for conveying an individual as in claim 1, wherein said drive assembly further comprises a motor speed reducer.

7. A monorail access system for conveying an individual as in claim 1, wherein said power source is a pair of batteries.

8. A monorail access system for conveying an individual, comprising:

an elongate overhead track, having a bottom portion and a top portion, said top portion being joined to an overhead support, wherein said overhead track has a channel defined therethrough;

an elongate engagement surface provided at the bottom portion of said elongate overhead track, a drive assembly housing;

a drive assembly, said drive assembly comprising a motor, a drive shaft extending from and driven by said motor and a gear mechanism which is secured to and rotatable with said drive shaft, wherein said gear mechanism engages said engagement surface, thereby propelling the drive assembly forward or in reverse;

a power source located within said drive assembly housing, wherein said power source powers said drive assembly;

a pair of weight bearing wheels disposed within said channel, wherein said wheels are uniaxially movable, said wheels being connected to said top surface of said drive assembly housing;

a chair assembly, having a top portion, center column and bottom platform, pivotally coupled to and moveable with said drive assembly housing;

a chair assembly connector having a first end and a second end, wherein a pivot is formed at said first end for pivotally and romovably mounting said chair assembly to said drive assembly housing, said second end being joined to the top portion of said chair assembly;

an axially rotating joint positioned between said chair assembly connector and said chair assembly; and a control means for controlling movement of the drive assembly.

9. A monorail access system for conveying an individual as in claim 8, wherein said axially rotating joint positioned between said chair assembly connector and said chair assembly comprises:

a pair of plates, positioned one on top of another, having uniformly spaced holes defined therethrough;

a means for locking against rotation comprising a pull, a retracting pin and a stop pin formed in the bottom plate; and a t-joint with a bearing mounted within said chair assembly connector which permits rotation of the axially rotating joint.

10. A monorail access system for conveying an individual as in claim 8, wherein said overhead track further comprises:

a switching mechanism which enables the drive assembly to round corners, wherein said switching mechanism comprises an articulated segment of track fixed to said overhead track by means of a pivot pin and support bearings.

11. A monorail access system for conveying an individual as in claim 1, wherein the width of said chair assembly is preferably between 12 and 24 inches wide.

12. A monorail access system for conveying an individual as in claim 1, wherein the width of said chair assembly is more preferably between 16 and 20 inches wide.

13. A monorail access system for conveying an individual as in claim 8, wherein the width of said chair assembly is preferably between 12 and 24 inches wide.

14. A monorail access system for conveying an individual as in claim 8, wherein the width of said chair assembly is more preferably between 16 and 20 inches wide.

15. A method for conveying an individual in a monorail access system, said method comprising the steps of:

(a) providing a monorail access system, said monorail access system comprising:

an elongate overhead track, having a bottom portion and a top portion, said top portion being joined to an overhead support, wherein said overhead track has a channel defined therethrough;

an elongate engagement surface provided at the bottom portion of said elongate overhead track, a drive assembly housing;

a drive assembly, said drive assembly comprising a motor, a drive shaft extending from and driven by said motor and a gear mechanism which is secured to and rotatable with said drive shaft, wherein said gear mechanism engages said engagement surface, thereby propelling the drive assembly forward or in reverse;

a power source located within said drive assembly housing, wherein said power source powers said drive assembly;

a pair of weight bearing wheels disposed within said channel, wherein said wheels are uniaxially movable, said wheels being connected to said drive assembly housing;

a chair assembly pivotally coupled to and suspended from said drive assembly housing; and a control mechanism to control the movement of the drive assembly, (b) seating an individual on said chair assembly, (c) energizing said drive assembly by means of said control mechanism, (d) conveying the individual seated on said chair assembly, said chair assembly being moveable with said drive assembly housing, to any local in which said overhead track is installed.

* * * * *